US007665974B2

(12) United States Patent
Hembree

(10) Patent No.: US 7,665,974 B2
(45) **Date of Patent: *Feb. 23, 2010**

(54) DIAPHRAGM PUMP POSITION CONTROL WITH OFFSET VALVE AXIS

(75) Inventor: Richard D. Hembree, Bellingham, WA (US)

(73) Assignee: Wanner Engineering, Inc., Minneapolis, MN (US)

( * ) Notice: Subject to any disclaimer, the term of this patent is extended or adjusted under 35 U.S.C. 154(b) by 56 days.

This patent is subject to a terminal disclaimer.

(21) Appl. No.: 11/743,505

(22) Filed: May 2, 2007

(65) Prior Publication Data

US 2008/0273997 A1 Nov. 6, 2008

(51) Int. Cl.
*F04B 9/08* (2006.01)
*F04B 43/067* (2006.01)
*F04B 35/02* (2006.01)

(52) U.S. Cl. ..... 417/387; 417/385; 417/386; 417/388; 417/395

(58) Field of Classification Search ..... 417/321, 417/324, 341, 346, 375, 379, 383, 385, 386, 417/387, 388, 395, 490, 559, 568; 92/84; 60/555; 141/69; 137/53
See application file for complete search history.

(56) References Cited

U.S. PATENT DOCUMENTS 1,920,014 A * 7/1933 Horton et al. ..... 417/393
2,679,209 A * 5/1954 Fischer et al. ..... 417/393
2,919,650 A * 1/1960 Wiggermann ..... 417/386
3,769,879 A * 11/1973 Lofquist, Jr., ..... 92/84
3,884,598 A * 5/1975 Wanner ..... 417/386
4,050,859 A 9/1977 Vork
4,381,180 A * 4/1983 Sell ..... 417/393
4,416,599 A * 11/1983 De Longchamp ..... 417/386
4,474,540 A * 10/1984 Bonastia et al. ..... 417/63
RE31,932 E * 7/1985 Christianson ..... 128/204.26
4,749,342 A * 6/1988 Fritsch ..... 417/388
4,865,528 A 9/1989 Fritsch et al.
4,883,412 A 11/1989 Malizard et al.
5,246,351 A 9/1993 Horn
5,326,234 A * 7/1994 Versaw et al. ..... 417/393
5,667,368 A 9/1997 Augustyn et al.
6,071,089 A 6/2000 Maier et al.

(Continued)

FOREIGN PATENT DOCUMENTS

EP 1 398 504 A1 3/2004

(Continued)

*Primary Examiner*—Devon C Kramer
*Assistant Examiner*—Nathan Zollinger
(74) *Attorney, Agent, or Firm*—Merchant & Gould PC

(57) ABSTRACT

A hydraulically driven pump includes a diaphragm, a piston, a transfer chamber, a fluid reservoir, and a valve spool. The transfer chamber is defined between the diaphragm and piston and is filled with a hydraulic fluid. The fluid reservoir is in fluid communication with the transfer chamber via at least one valve. The valve spool is configured to control fluid flow between the transfer chamber and the fluid reservoir. The valve spool is movable to open and close an opening into the at least one valve only when an overfill condition or an underfill condition exists in the transfer chamber. The valve spool is moveable along an axis that is non-coaxial with an axis of movement of the diaphragm.

21 Claims, 6 Drawing Sheets

U.S. PATENT DOCUMENTS

| | | | | |
|---|---|---|---|---|
| 6,899,530 | B2 * | 5/2005 | Lehrke et al. | 417/395 |
| 7,063,517 | B2 * | 6/2006 | Towne et al. | 417/395 |
| 7,090,474 | B2 * | 8/2006 | Lehrke et al. | 417/395 |
| 7,425,120 | B2 * | 9/2008 | Hembree | 417/387 |
| 2004/0228748 | A1 | 11/2004 | Lehrke et al. | |
| 2006/0239840 | A1 | 10/2006 | Hembree | |

FOREIGN PATENT DOCUMENTS

| | | |
|---|---|---|
| WO | WO 91/11616 | 8/1991 |

* cited by examiner

DIAPHRAGM PUMP POSITION CONTROL WITH OFFSET VALVE AXIS

BACKGROUND OF THE INVENTION

1. Field of the Invention

The present invention generally relates to fluid pumps and more specifically relates to hydraulically driven diaphragm pumps.

2. Related Art

Hydraulically driven diaphragm pumps can be divided into at least two groups. The first group includes pumps that use a different stroke for the hydraulic piston or plunger than that of the diaphragm. These pumps can be referred to as asynchronous pumps. Asynchronous pumps are commonly used for metering in large diaphragm pumps where it is desirable to have a large diameter diaphragm that only deflects a small amount (a "short stroke"). Short stroke diaphragms are typically driven by a much longer stroke hydraulic plunger or piston. The long stroke of the piston makes possible the use of a small diameter for the piston, which result in smaller loads on the crankshaft and crankcase that must move the piston through its stroke.

The second group includes pumps where the diaphragm center moves the same distance as the hydraulic piston. These pumps can be referred to as synchronous pumps. The diaphragm position in synchronous pumps is controlled by a valve in the piston that maintains a constant distance between the piston and diaphragm center.

An example valving system for diaphragm position control in synchronous pumps is disclosed in U.S. Pat. No. 3,884,598 (Wanner), which is incorporated herein by reference. Wanner discloses a system that senses the position of the diaphragm relative to the piston, and then functions to keep the position of the diaphragm constant. The Wanner system is useful for pumps that must operate at a high speed or that pump abrasive materials because the system permits the use of elastomeric diaphragms that do not need to come into contact with a stop surface at the end of stroke. However, if the piston travels more than the travel distance of the diaphragm, this system will not be able to properly maintain the amount of hydraulic fluid behind the diaphragm for the pump to function properly.

Some example asynchronous pumps are described in U.S. Pat. No. 5,246,351 (Horn), U.S. Pat. No. 5,667,368 (Augustyn), and U.S. Pat. No. 4,883,412 (Malizard). These example pumps all use a similar approach to diaphragm position control. Each of these pumps momentarily adjusts the amount of oil at the top or bottom of every stroke. An overfill condition is detected when the diaphragm travels too far forward and reaches a limit of travel. This causes a higher than normal pressure of the hydraulic fluid, which causes a valve to momentarily open and release some of the excess fluid. This excess pressure is generated when the diaphragm reaches a stop, or simply the end point of deflection where higher pressure is required to move the diaphragm further. This pressure is not transmitted to the pumped fluid and therefore produces an unbalanced pressure drop across the diaphragm. This method of dealing with pressures created by overfill requires that the diaphragm includes materials and a configuration adequate to handle this unbalanced pressure without the diaphragm failing. This limitation on diaphragm materials and design results in the use of very large diameter, low deflection diaphragms that greatly increase the size and cost of the pump.

Known asynchronous hydraulically driven pumps do not allow for the use of highly flexible elastomeric diaphragms that are relatively small and capable of undergoing large deflections for at least those reasons discussed above. As a result, the use of these types of diaphragms is limited to synchronous pumps. The piston stroke in a synchronous pump must be relatively short since it is limited to the diaphragm stroke. This makes the crankshaft and crankcase bear the higher loads of a larger diameter piston, making the drive side of the pump more expensive.

Another example hydraulically driven pump is disclosed in U.S. Pat. No. 3,769,879 (Lofquist). Lofquist discloses a spool that moves with every stroke of the diaphragm to momentarily open ports between a fluid reservoir and the hydraulic chamber (e.g., transfer chamber) behind the diaphragm at the ends of the piston stroke. The ports and moving spool allow only a small pulse of fluid to pass with each stroke in order to correct an overfill or underfill condition.

Lofquist has some significant disadvantages under conditions of extreme underfill or overfill (e.g., conditions caused by very low or very high pump inlet pressure for the pumped fluid). Under extreme overfill conditions, the small pulse of fluid permitted with each stroke is insufficient to immediately correct the overfill, which results in stressing of the diaphragm until enough strokes occurred to correct the overfill condition. Another shortcoming of Lofquist relates to the direction in which the diaphragm is biased. Under extreme conditions (e.g., low inlet and outlet pressure for the pumped fluid caused by, for example, a blocked inlet to the pump), the Lofquist system tends to add oil to the transfer chamber without any bias applied to the diaphragm that would otherwise discharge the overfill of oil. As a result, the overfill cannot be solved and the diaphragm will fail.

There is a need for improvements in diaphragm position control for diaphragm pumps.

SUMMARY

One aspect of the present disclosure relates to a diaphragm pump that includes a piston, a diaphragm, pumping and transfer chambers, first and second valves, a fluid reservoir, and a valve spool. The piston is adapted for reciprocal movement between a first position and a second position. The diaphragm is movable between first and second positions that correlate with the first and second piston positions. The transfer chamber is positioned on one side of the diaphragm and is defined in part by the relative positions of the diaphragm and the piston. The transfer chamber is filled with a hydraulic fluid. The pumping chamber is positioned on an opposing side of the diaphragm from the transfer chamber. The fluid reservoir is in fluid communication with the transfer chamber via the first and second valves. The valve spool is positioned in the transfer chamber and arranged to cover access openings of the first and second valves when the valve spool is in a first position, to cover the opening of the first valve and open the opening of the second valve when the valve spool is in a second position, and to open the opening of the first valve and close the opening of the second valve when the valve spool is in a third position. The spool typically maintains the first position until an overfill condition is generated in the transfer chamber that moves the spool to the second position, or until an underfill condition is generated in the transfer chamber that moves the spool to the third position. The pump further includes an actuating member that is attached to the moving portion of the diaphragm that engages the spool to move the spool between the first, second and third positions. The actuating member permits placement of the spool on a different axis than the rod and spring that are used to provide the diaphragm bias pressure. The spool can be positioned on a separate axis from the diaphragm, the diaphragm rod and spring, and the main piston of the pump.

Related methods of operating such a diaphragm pump to control fluid pressures in the pump are also important aspects of the present disclosure.

The above summary is not intended to describe each disclosed embodiment or every implementation of the inventive aspects disclosed herein. Figures in the detailed description that follow more particularly describe features that are examples of how certain inventive aspects may be practiced. While certain embodiments are illustrated and described, it will be appreciated that disclosure is not limited to such embodiments.

DETAILED DESCRIPTION OF THE PREFERRED EMBODIMENT

Figure 1:
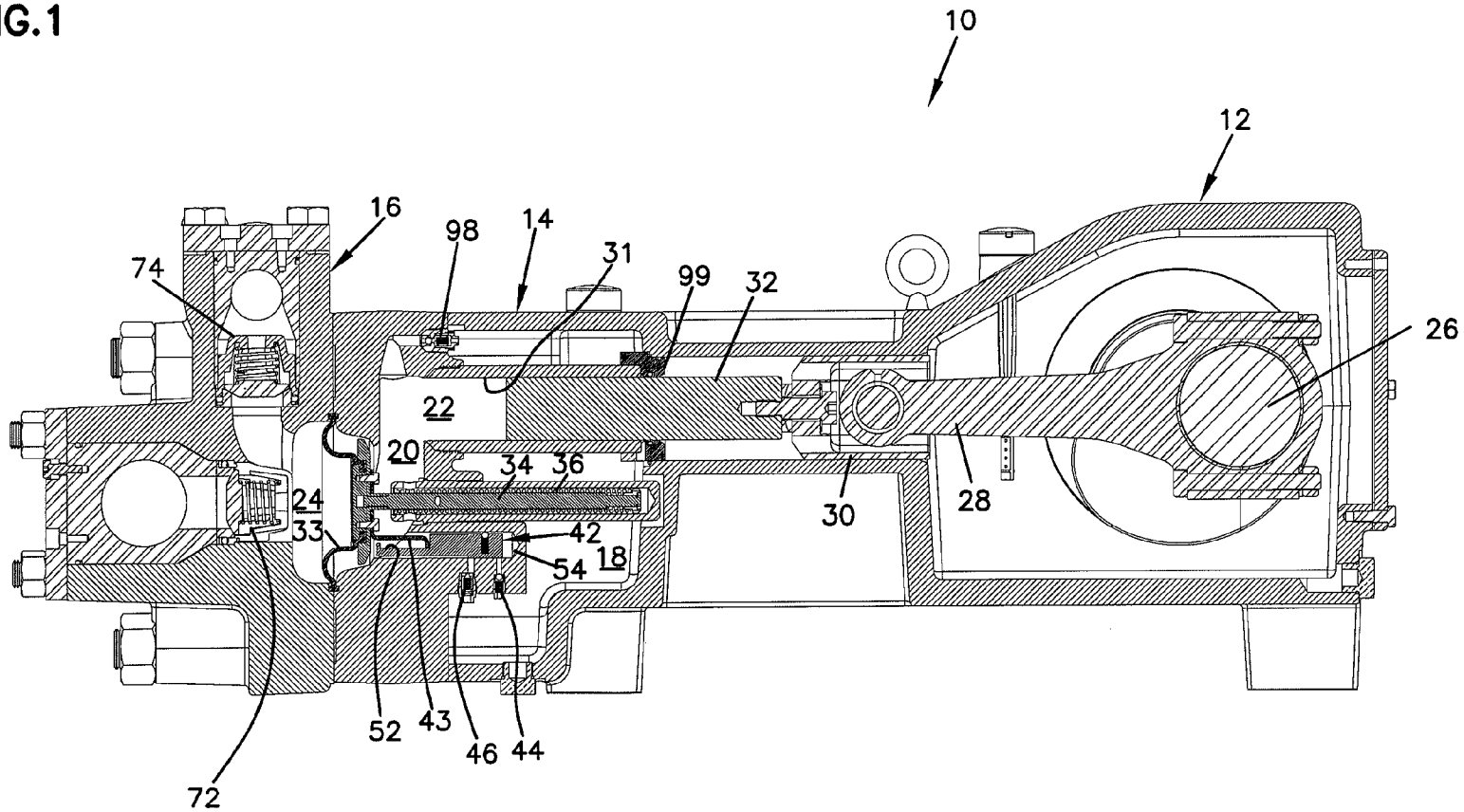
FIG. 1 is a cross-sectional side view of an example pump according to principles of the present disclosure with the pump piston in a bottom dead center (BDC) position with a normal fill condition.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The following discussion is intended to provide a brief, general description of a suitable environment in which the invention may be implemented. Although not required, the invention will be described in the general context of diaphragm pumps. The structure, creation, and use of some example diaphragm position control devices and systems, and their related methods of use, are described hereinafter.

The present disclosure generally relates to fluid pumps such as hydraulically driven diaphragm pumps. Principles of the present disclosure are equally applicable to asynchronous and synchronous pumps. In asynchronous pumps there is a different stroke for the hydraulic piston versus a stroke of the diaphragm. The diaphragm is typically relatively large in diameter and is configured to deflect a relatively small amount. This short stroke diaphragm is driven by a much larger stroke hydraulic plunger or piston. The longer the stroke of the hydraulic plunger or piston, the smaller the diameter of the piston is required, which imparts smaller loads on the crankshaft and crankcase of the pump.

Synchronous pumps are configured such that the center of the diaphragm moves the same distance as the hydraulic piston moves. In such pumps, the diaphragm must deflect large distances corresponding to the piston stroke in order to minimize loads on the crankcase and crankshaft resulting from use of a relatively small diameter piston. If it is not possible for the diaphragm to deflect to the extent necessary to ensure a relatively small diameter piston, the piston diameter must be enlarged, thus creating greater loads on the crankshaft and crankcase. The present disclosure can be used with either of asynchronous or synchronous pumps to help control a position of the diaphragm to ensure that the diaphragm does not extend or retract beyond predetermined distances that may otherwise lead to failure of the diaphragm.

Many known diaphragm position control systems function based on hydraulic pressure conditions within the transfer chamber on a side of the diaphragm opposite of the fluid being pumped. Such pressure-based systems typically utilize relief valves that open or close in response to certain pressure levels. The relief valves are typically positioned between the hydraulic chamber and a reservoir of hydraulic fluid. In systems designed for relieving overpressure, the relief valve momentarily opens to release some of the hydraulic fluid to the reservoir when a maximum pressure is surpassed. In systems designed for relieving under pressure, a separate relief valve momentarily opens to draw some hydraulic fluid from the reservoir into the hydraulic chamber when the pressure drops below a minimum pressure.

Overpressure is typically generated in such systems at the point where the diaphragm reaches a stop such as at the end of deflection where high pressure is required to deflect the diaphragm further. In order to account for the overpressure conditions, the diaphragm must be made of a relatively strong, inflexible material that can resist failure after repeated cycles of high and low pressure. Increasing the diameter and decreasing the amount of deflection the diaphragm must make can also account for the high pressure conditions, but can also greatly increase the size and cost of the pump.

Another issue related to pressure-based systems is cavitation. The excess pressure in the transfer chamber is typically not transmitted to the pumped fluid and therefore creates an unbalanced pressure condition (i.e., pressure drop) across the diaphragm. This pressure drop can lead to vacuum conditions during certain portions of the piston stroke that may lead to cavitation in the hydraulic fluid. Cavitation can lead to increased wear (e.g., pitting) of the components exposed to the hydraulic fluid.

The present disclosure functions based on volume rather than pressure within the hydraulic chamber. Depending on the underfill or overfill volume condition within the hydraulic chamber, a movable valve spool shifts in the hydraulic chamber between positions covering or uncovering openings to check valves that are positioned between a hydraulic reservoir and the hydraulic chamber. It is the fluid itself rather than a pressure condition generated by the fluid that moves the valve spool. The underfill and overfill volume conditions are typically best assessed at either the top or bottom of the piston stroke. The present disclosure is configured such that the valve spool moves only at the top or bottom of the piston stroke to correct the underfill or overfill condition.

Applicant's co-pending U.S. Published Patent Application No. 2006/0239840, which is incorporated herein by reference, describes a system for controlling the position of a diaphragm in a hydraulically driven diaphragm pump so the diaphragm operates within a safe range of travel. That system uses a valve spool that is moved when the oil-filled transfer chamber is either overfilled or underfilled. When the transfer chamber is overfilled with oil, the diaphragm travels too far forward when the piston is at the top of the piston stroke. This overfilled position moves the valve spool, opening a port that allows the oil to leave the transfer chamber through a first one-way valve. When the transfer chamber is underfilled, the diaphragm travels too far back, thereby moving the valve spool so that the valve spool exposes a port that allows oil to come into the transfer chamber through a second one-way valve.

Publication 2006/0239840 shows the valve spool positioned along the axis of the diaphragm, which is co-axial with a rod attached to the center of the diaphragm. This diaphragm rod generally is used to oppose the force of a bias spring that puts a slightly higher pressure on the oil in the transfer chamber than the fluid being pumped on the other side of the diaphragm. The rod also has a feature that comes in contact with the spool when overfill or underfill conditions exist, thereby moving the valve as described above. The coaxial spool must be designed to come into contact with the feature on the rod, while at the same time allowing for the coaxial spring that resides either inside or outside of the diaphragm rod. The overall structure and configuration for the diaphragm pump disclosed in publication 2006/0239840 tends to be relatively complicated, difficult to assemble, and can result in undesirable sizes for the spool and other components.

The present disclosure provides for simpler components and structure for the control valve system than those used in, for example, publication 2006/0239840. On such component is an actuating member that is attached to a moving portion of the diaphragm. The actuating member engages the valve spool to control oil flow between the transfer chamber and oil reservoir during overfill and underfill conditions. The actuating member permits positioning of the valve spool on a different axis than the axis of the diaphragm rod and spring that are used to provide the diaphragm bias pressure. Positioning the valve spool on a separate axis can simplify the diaphragm pump in several ways. For example, the diaphragm rod and bias pressure spring are required only to provide the limited function of applying a pressure bias. Generally, this means that the size of the spring can be made smaller and the bore that the spring fits into is smaller (in the case of positioning the spring internal of the diaphragm rod). Further, the spool member does not require the highly smooth finish that the bore for a valve spool requires.

Another advantage of providing the valve spool on a separate axis is that the valve spool can now be much smaller in diameter. Since the spool no longer needs to have a hole along its axis to house the diaphragm biasing spring, the spool can be much smaller in diameter and the corresponding bore that houses the spool can also be much smaller. The smaller bores for both the diaphragm bias spring and spool provides exposure of less area in the pump housing to the high pressure generated in the transfer chamber, which results in lower stress forces in the pump generally. The smaller bores also results a reduced volume of oil needed in the transfer chamber, which results in a lower bulk modulus for the system and higher volumetric efficiency.

A further advantage of providing the valve spool on a separate axis is that the valve spool no longer requires a cylindrical shape. The valve spool can include a flat construction such as a ceramic disc member or other structure. A flat construction can provide the option of creating relative low clearance seal interfaces, and in some cases a lower cost design.

The Example Diaphragm Pump of FIGS. 1-4A

Figure 2:
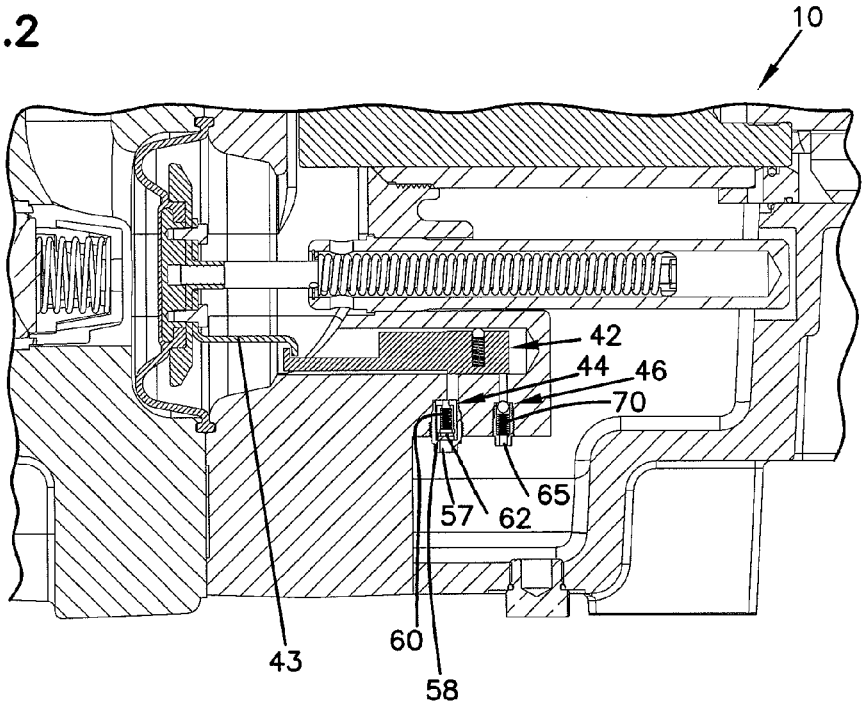
FIG. 2 is a cross-sectional side view of the example pump shown in FIG. 1 with the pump piston in a top dead center (TDC) position with a normal fill condition.
Figure 3:
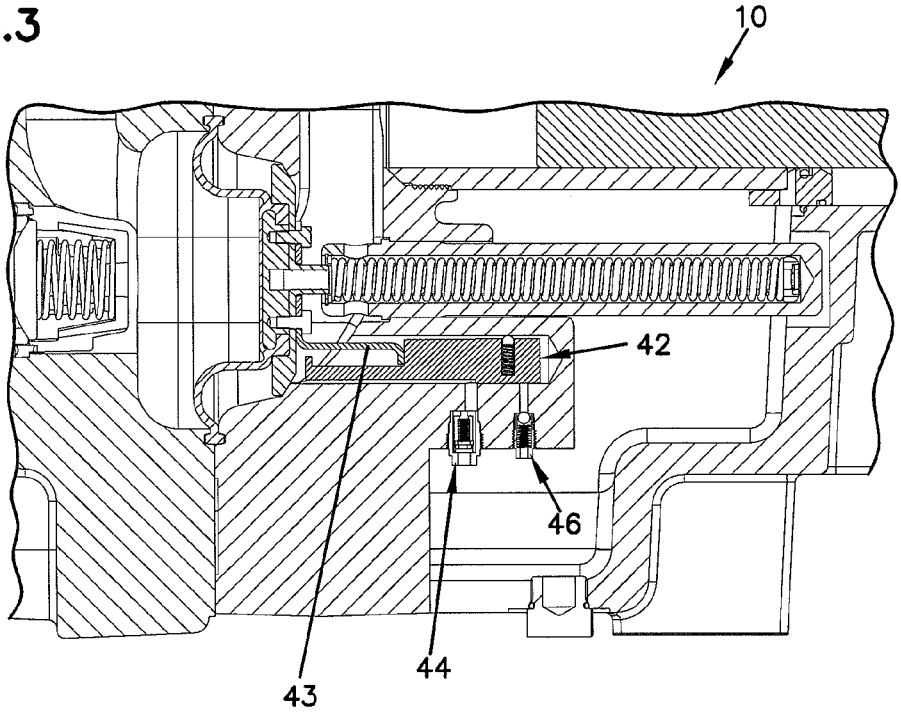
FIG. 3 is a cross-sectional side view of the example pump shown in FIG. 1 with the pump piston in a bottom dead center (BDC) position with an underfill condition.
Figure 4:
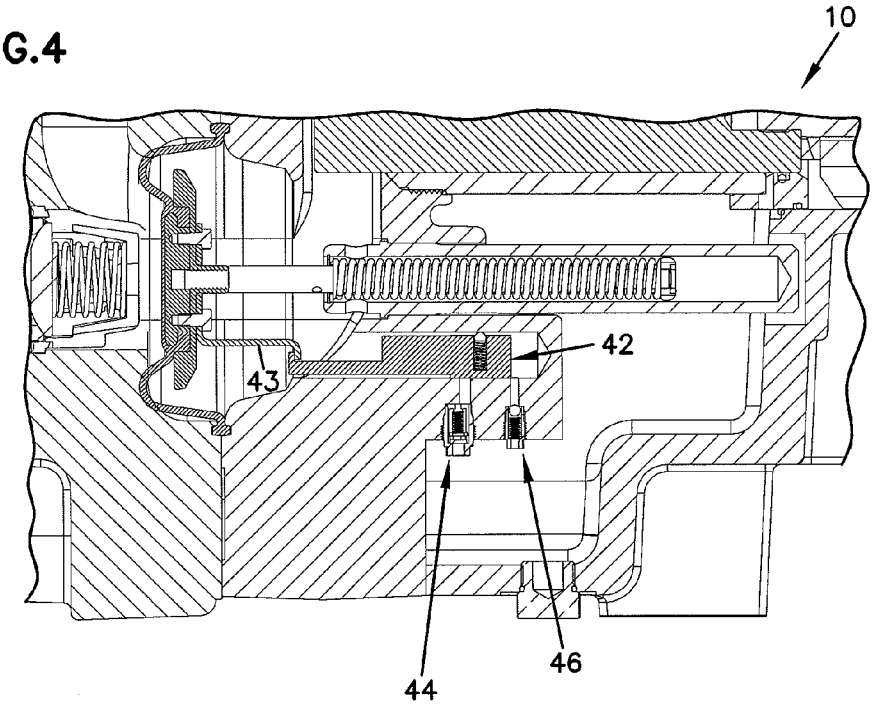
FIG. 4 is a cross-sectional side view of the example pump shown in FIG. 2 with the pump piston in a top dead center (TDC) position with an overfill condition.

An example asynchronous diaphragm pump 10 that illustrates principles of the present disclosure is shown and described with reference to FIGS. 1-4A. FIG. 1 illustrates the pump piston at bottom dead center (BDC) with a normal fill condition. FIG. 2 illustrates the piston at a top dead center (TDC) with a normal fill condition. FIG. 3 illustrates the piston at BDC with an underfill condition. FIG. 4 illustrates the piston at a top dead center (TDC) with an overfill condition.

Pump 10 includes a crankcase 12, a piston housing 14, and a manifold 16. The piston housing 14 defines a reservoir 18, a transfer or hydraulic chamber 20, and a plunger chamber 22. The manifold 16 defines a pumping chamber 24 and includes inlet and outlet valves 72, 74.

A crankshaft 26, connecting rod 28, and slider 30 are positioned within the crankcase 12. The slider 30 is coupled to a plunger 32 positioned within the plunger chamber 22. The transfer and plunger chambers 20, 22 are in fluid communication with each other such that fluid drawn into or forced out of the plunger chamber 22 draws the diaphragm into a retracted position or forces the diaphragm into an extended position as shown in FIGS. 1 and 2, respectively.

A diaphragm rod 34 extends through the transfer chamber 20. A spring 36 is positioned co-axially with the rod 34 to exert a biasing force on the diaphragm in a rearward direction to help maintain a higher pressure condition in the transfer chamber 20 than in the pumping chamber 24. Maintaining a higher pressure condition in the transfer chamber 20 can improves performance of the pump 10 under suction inlet conditions.

Figure 2A:
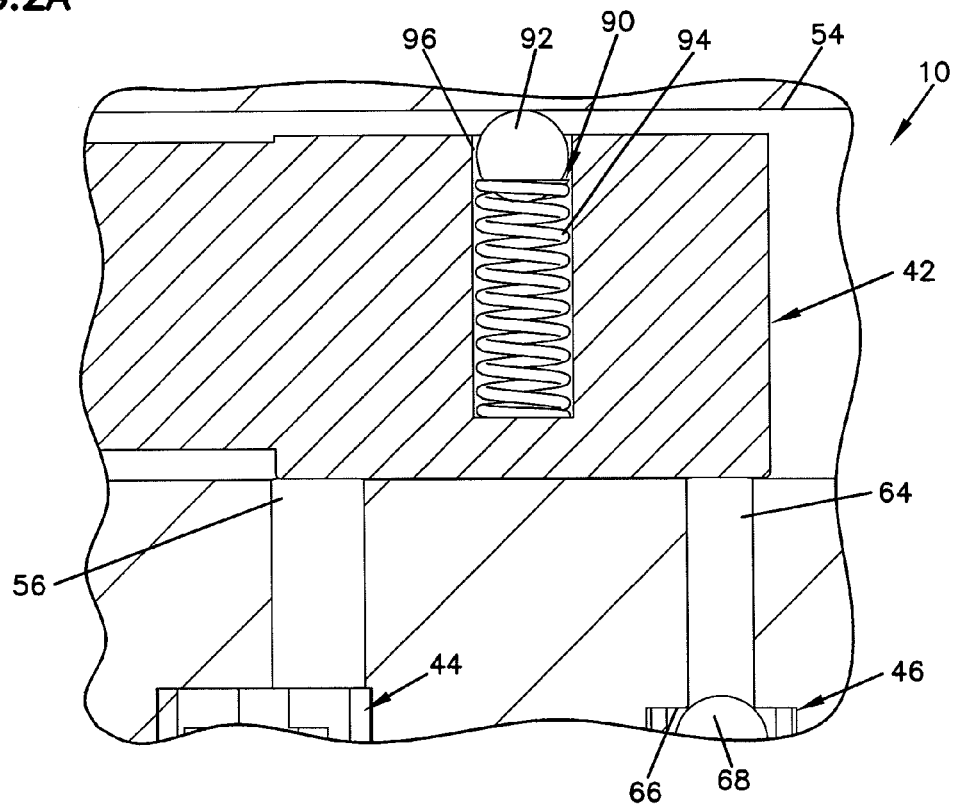
FIG. 2A is a close up view of the valve positions shown in FIG. 2.
Figure 3A:
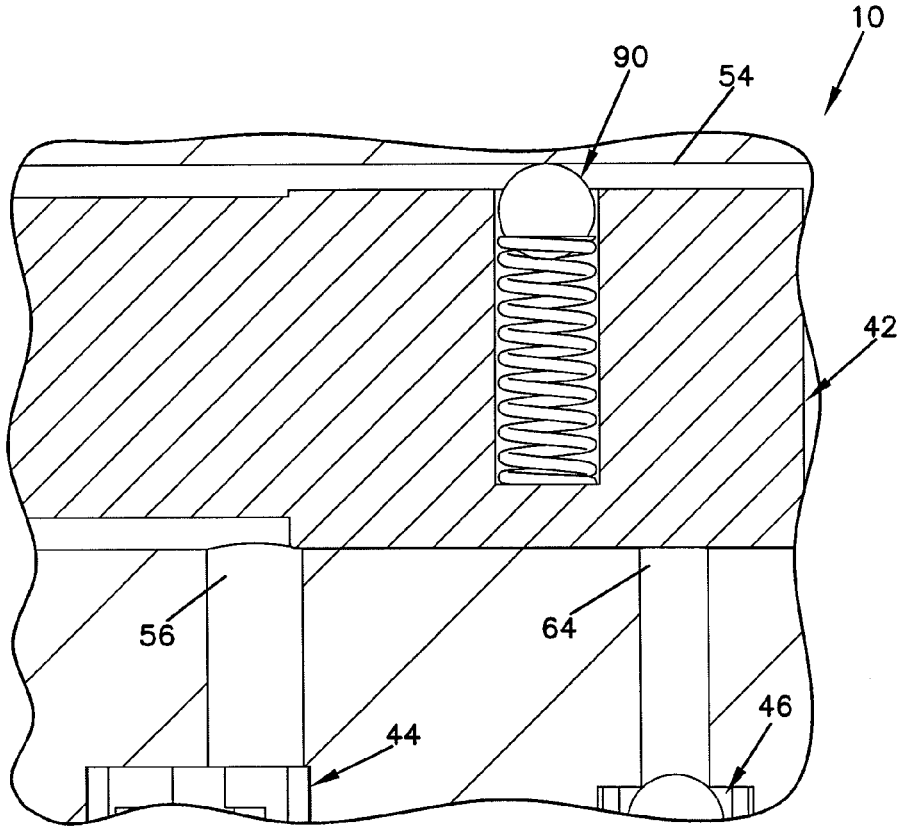
FIG. 3A is a close up view of the valves shown in FIG. 3.
Figure 4A:
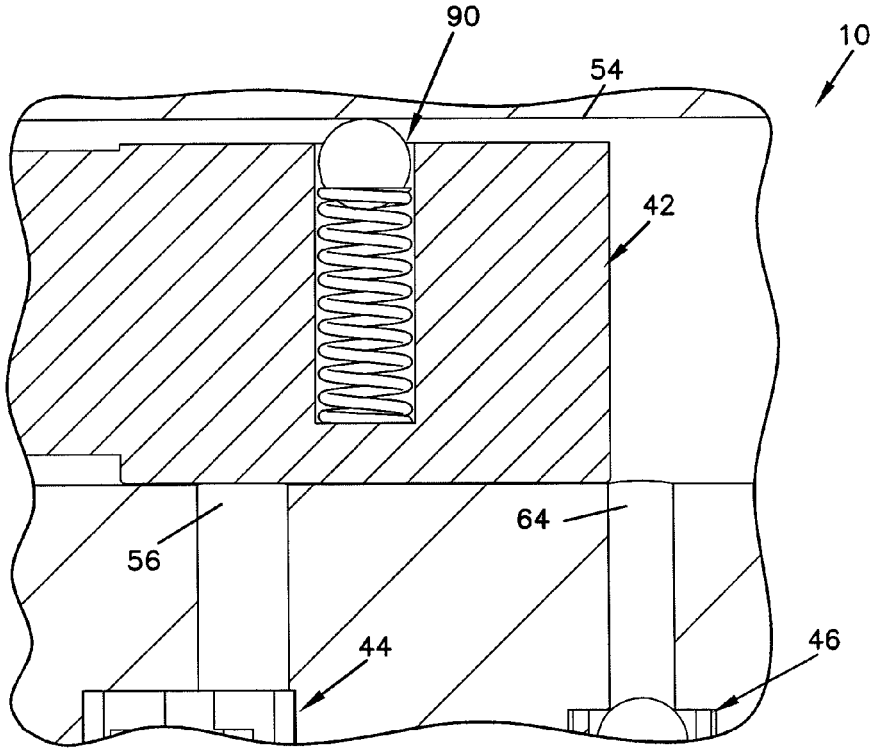
FIG. 4A is a close up view of the valves shown in FIG. 4.

A spool bore 54 is defined in the piston housing 14 adjacent to the diaphragm rod 34. The spool bore is sized to receive a valve spool 42. The spool recess 52 is sized such that the valve spool 42 that is movable in a direction parallel with movement of the diaphragm rod 34. The valve spool 42 is movable between a first position providing access to an opening 56 of an underfill valve 44 and covering an opening 64 of an overfill valve 46 (see the underfill orientation of FIGS. 2, 2A), a second position substantially covering openings 56, 64 (see the steady-state orientation of FIGS. 3, 3A), and a third position covering opening 56 and providing access to opening 64 (see the overfill orientation of FIG. 4, 4A). The close-up views of FIGS. 2A, 3A and 4A illustrate more clearly the open or closed state of the openings 56, 64 in each of the steady-state, underfill, and overfill conditions.

The diaphragm pump 10 includes an underfill valve 44 associated with the opening 56, and an overfill valve 46 associated with the opening 64. The underfill valve 44 includes another opening 57 positioned adjacent to the hydraulic chamber 18. The underfill valve 44 also includes a seat 58, a spring 60, and a plug 62. The spring 60 biases the plug 62 against the seat 58 until the spool 42 is moved to uncover the opening 56. When the opening 56 is uncovered, fluid is drawn into the transfer chamber 20 via the underfill valve 44. The overfill valve 46 includes a seat 66, a ball 68 and a spring 70. The spring 70 biases the ball 68 against the seat 66 until the spool 42 is moved to uncover the opening 64. When the opening 64 is uncovered, fluid is forced out of the transfer chamber 20 via the overfill valve 46. The underfill and overfill valves 44, 46 are check valves that permit one-way fluid flow.

The valve spool 42 provides an important function of controlling fluid flow between the transfer chamber 20 and the reservoir 18 during underfill, overfill, and steady-state conditions in the transfer chamber 20. The valve spool 42 moves depending on a position of the diaphragm 42. One end of a valve arm 43 is mounted to the diaphragm 33 and an opposing end of the valve arm 43 is positioned in a spool recess 52 of the valve spool 42. The spool recess 52 has a length greater than the amount of movement of the diaphragm 33 during steady-state operating conditions. The spool recess 52 provides a "dwell zone", wherein the valve arm 43 can freely move without moving the valve spool 42 until an overfill or underfill condition occurs in the transfer chamber 20.

In normal high pressure operation of the pump 10, a small amount of oil will flow from the plunger chamber 22 into the reservoir 18 by way of a clearance between the plunger piston 32 and a bore 31 that the plunger piston 32 moves within. This loss of oil is replaced by oil that is drawn into the transfer chamber 20 through the underfill valve 44 during the suction stroke of the pump 10. In this normal operating state, the spool 42 is positioned to expose a portion of the underfill opening 56, as shown in FIGS. 1, 2, 2A. This normal equilibrium position is achieved when diaphragm 33 at its bottom dead center (BDC) position and the attached valve arm 43 moves the spool 42 rearward until enough of the opening 56 is exposed so that the flow entering the transfer chamber 18 through the opening 56 is equal to the flow leaving though the clearance between plunger piston 32 and bore 31. This process of equalization occurs over several strokes of the pump 10 as the diaphragm 33 moves further and further rearward with the loss of fluid out of the transfer chamber 20. Once equilibrium is reached in the amount of fluid leaving the transfer chamber 20 and the amount of fluid entering the transfer chamber via valve 44, the spool 42 remains stationary until some change in the pumping condition occurs that changes the rate of fluid loss.

Movement of the spool 42 into the other positions shown in FIGS. 3, 3A, 4, 4A depends on the pumping conditions for the pump 10. A first common condition occurs at startup of the pump 10. When the pump 10 has been inoperative, fluid from the transfer chamber leaks out through the clearance between plunger piston 32 and the bore 31 due to pressure applied to the diaphragm 33 from the spring 36, or from residual pressure within the pump 10. When the pump 10 is restarted, there is too little fluid in the transfer chamber 20, which results in the diaphragm 33 traveling too far rearward in the transfer chamber 20 when the plunger piston 32 is at BDC (e.g., see FIGS. 3, 3A. This condition is the underfill condition referenced above. When the underfill condition exists, the valve arm 21, which moves with the diaphragm 33, moves the spool 42 so that the spool 42 completely covers the overfill opening 64 and exposes the underfill opening 56 (see FIGS. 3, 3A). With the spool 42 in this position, fluid is drawn into the transfer chamber 20 from the reservoir 18 through the underfill valve 44 during the suction stroke of the pump 10. As the transfer chamber 20 becomes less overfilled with each consecutive stroke of the pump, the valve arm 43 engages the valve spool 42 forward to eventually attain steady-state equilibrium position described above with reference to FIGS. 1, 2, 2A.

The second common condition occurs when there is a restriction on the inlet line to the pump 10 that causes a low pressure inlet condition and a loss of outlet pressure. The low pressure inlet condition permits the diaphragm 33 to travel further forward than normal when the plunger is at top dead center (TDC). This condition is called the overfill condition and is shown with reference to FIGS. 4, 4A. When the overfill condition exists, the valve arm 43 urges the spool 42 forward so that the spool 42 completely covers the underfill opening 56 and exposes the overfill opening 64. Excess fluid is then permitted to travel out of the transfer chamber 20 through the overfill opening 56 and overfill valve 46 and into the reservoir 18.

As described above, the spool will seek an equilibrium position to match the flow of fluid leaving and entering the transfer chamber 20. The position of the spool 42 remains unchanged until the pumping conditions change causing the valve arm 43 to move the spool 42. In order to prevent the spool 42 from moving on its own from vibration or gravity forces, the pump 10 should include a device that inhibits movement of the spool 42 until engaged by the valve arm 43. A spool retainer 90 having a ball 92 and spring 94 are positioned in a spool retainer recess 96 in the spool 42. The spool retainer 90 generates a friction force against the spool bore so the spool 42 does not move on its own.

Attaining the equilibrium steady-state point for a particular pumping condition is now further described again with reference to FIGS. 1, 2, 2A. During equilibrium steady-state conditions, the spool 42 does not move until the pump conditions change. This fine tuning of fluid flow into and out of the transfer chamber 20 comes from the very small changes in diaphragm TDC or BDC positions. These changes are proportional to the leak rate from the transfer chamber per stroke, divided by the displacement of the plunger. For example, on a seal-less pump that has a cylinder displacement of about 200 cubic centimeters (cc), the leak rate from the transfer chamber when operating at full pressure will be about 1 cc per stroke. When the valve is covering both the overfill and underfill openings 56, 64 so that the only fluid leaving the transfer chamber 20 is from the leak around plunger piston 32, then the diaphragm stroke position will move by about 1/200 of the diaphragm stroke. In the example of a 200 cc displacement, the diaphragm 33 travel would be about 1.5 inches, so the decrease in BDC per stroke is about 0.0075 inches. The stroke position of the diaphragm will move 0.0075 inches back with each stroke until the spool 42 starts to uncover the underfill opening 56. Once the underfill opening 56 is slightly open, a small amount of fluid enters the transfer chamber 20 on each suction stroke. That oil coming in is subtracted from the rate of fluid leaving the transfer chamber 42 via the plunger piston 32 so that the net loss per stroke is less on the next stroke.

In one example, if the spool 42 is opened 0.007 inches on the first movement of the spool 42 by engagement with the valve arm 43, the fluid entering the transfer chamber 20 on the suction stroke could be 0.5 cc and the net fluid leaving the transfer chamber 20 is now only 0.5 cc. The next stroke will only move the spool 42 by half as much as the previous movement, and continues to make smaller adjustments with each stroke. In practice, this adjustment process takes several strokes of the pump 10 and less than a few seconds of time, depending on the pump operation settings. The same process occurs when the pumping conditions are causing an overfill condition. An overfill condition occurs when the inlet to the pump 10 is restricted and there is low pressure on the outlet of the pump 10. Under these conditions the transfer chamber 20 will slowly increase in fluid volume with each stroke; again by small amounts (e.g., 1 cc per stroke). A similar process of gradually opening the overfill opening 64 now occurs until the amount of fluid entering the transfer chamber 20 from the plunger piston clearance is equal to the amount leaving the transfer chamber 20 via the overfill valve 46.

FIG. 1 further illustrates an air bleed valve 98 that is designed to allow air to escape from the transfer chamber 20 (e.g., during pump startup), but prevents significant liquid (e.g., hydraulic fluid or oil) leakage during normal operation. A wiper seal 99 is positioned on the plunger 32 to contain the hydraulic oil in the reservoir 18. This seal is not configured to maintain the high pressure of the transfer chamber 20. The high pressure of the transfer chamber 20 is maintained by a close fit between the plunger 32 and the bore 31. Fluid that passes through this high pressure clearance between plunger 32 and bore 31 is maintained at the same pressure as the reservoir 18, and the wiper seal 99 helps keep the fluid in the reservoir 18 so that the fluid is separate from the oil held in crankcase 12.

Figure 5:
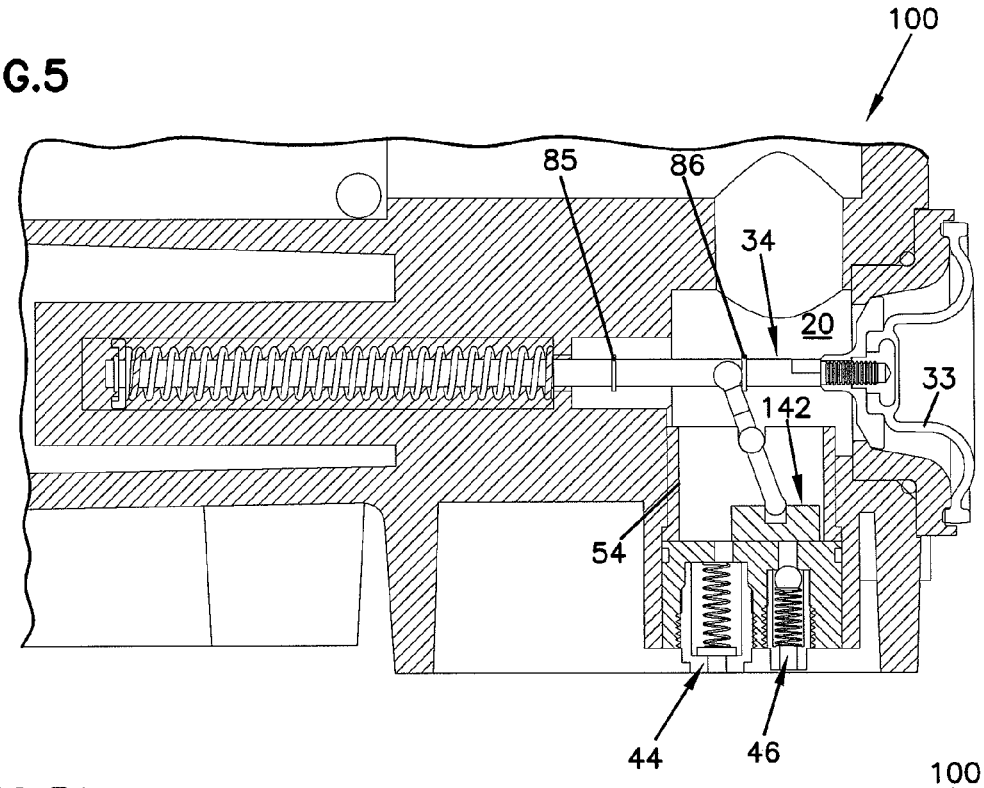
FIG. 5 is a cross section of an example of an alternative lever type actuator arm shown in the BDC underfilled condition.
Figure 5A:
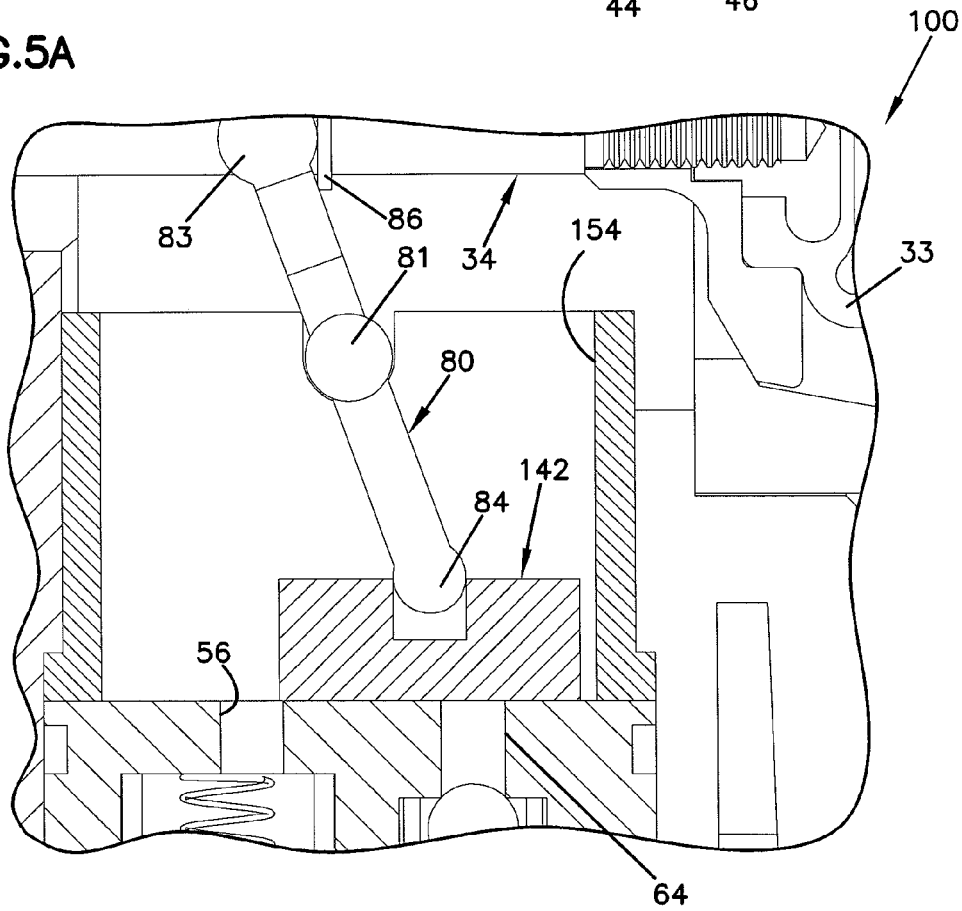
FIG. 5A is a close-up view of the valves shown in FIG. 5.
Figure 6:
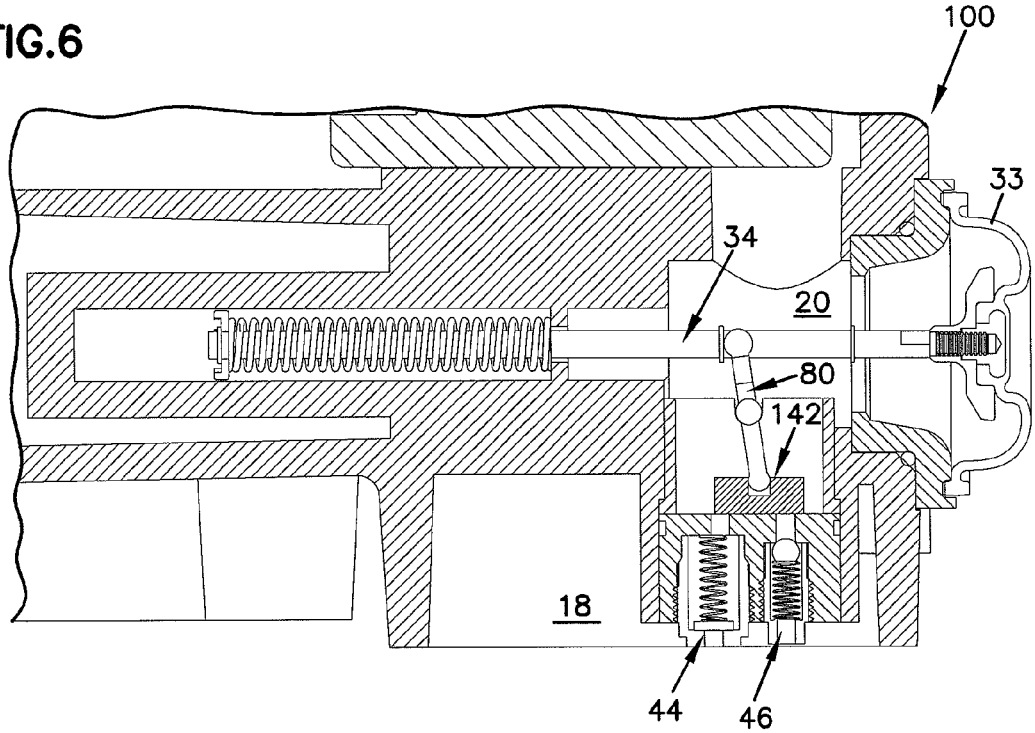
FIG. 6 is a view of the valve shown in FIG. 5 in a TDC normal fill condition.
Figure 6A:
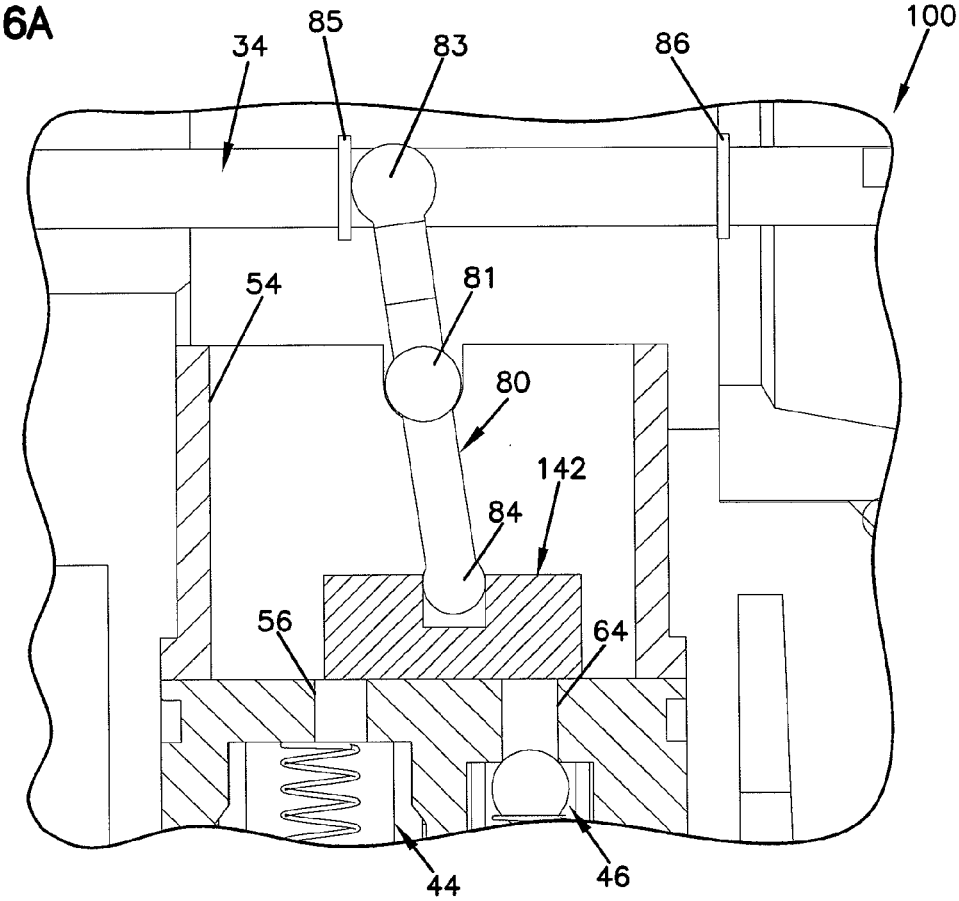
FIG. 6A is a close-up view of the valves shown in FIG. 6.

The Example Diaphragm Pump of FIGS. 5-6A

Referring now to FIGS. 5-6A, another example pump 100 that incorporates principles of the present disclosure is shown and described. Pump 100 includes many of the same features as described above with reference to FIGS. 1-4A. Pump 100 includes a different valve spool 142 that is operated using a lever 80. The valve spool 142 is positioned in a spool bore 154 that is offset from the diaphragm rod 34. The valve spool 142 is movable in a direction parallel with the direction of movement of the diaphragm rod 34 and diaphragm 33. The lever 80 operatively couples the diaphragm rod 34 with the spool valve 42. The lever 80 includes a fulcrum 81, and first and second connections 83, 84. The lever 80 pivots about the fulcrum 81. The first connection 83 is coupled to the diaphragm rod 34. The second connection 84 is coupled to the valve spool 42. The first connection 83 provides sliding engagement of the lever 80 on the diaphragm rod 34. A pair of first and second stops 85, 86 are positioned along the diaphragm rod 34 to control the distance of travel for the lever 80 along the diaphragm rod 34.

The space defined between the stops 85, 86 define a "dwell zone" that permit the valve spool 42 to remain stationary during steady-state operation of the pump 10 until occurrence of an overfill or underfill condition in the transfer chamber 20. In an underfill condition, the diaphragm 33 is permitted to move further rearward in the transfer chamber 20, causing the stop 86 to rotate the lever 80 about the fulcrum 81 to move the valve spool 42 forward to expose the underfill opening 56. In an overfill condition, the diaphragm 33 moves further forward than in a steady-state condition, causing the stop 85 to rotate the lever 80 about the fulcrum 81 to move the valve spool 42 rearward to expose the overfill opening 64.

Many variations of the valve spool arrangements shown with reference to FIGS. 1-6A are possible. In one example, the valve spool and related overfill and underfill valves can be combined together as a pre-assembled product that is mounted as a single piece within the pump. In another example, the valve spool can be arranged so that it moves in a direction perpendicular (or any non-parallel direction) relative to the direction of movement of the diaphragm rod and diaphragm. Further, the valve spool can be positioned laterally to the side or vertically above the diaphragm rod, as opposed to the position of the valve spool vertically below the diaphragm rod as shown in FIGS. 1-6A.

Further Considerations

The valve spool described with reference to the above examples can maintain a static position so long as there is a correct amount of hydraulic oil in the transfer chamber behind the diaphragm. The valve spool can maintain this static state regardless of the position of the diaphragm during its stroke between fully extended and fully retracted positions. When in a static state, the valve spool covers openings to the check valves positioned between the transfer chamber and the fluid reservoir. Thus, the valves are typically operated only when an overfill or underfill condition is present such that the valve spool moves to expose an opening to one or the other check valve. The limited operation of the relief valves provides some advantages over pressure-based systems in which the relief valve is actuated at the top or bottom of every piston stroke. The more a valve is operated, the more susceptible the valve is to wear.

Another advantage of the example pumps described herein relates to the number of components necessary to correct both overfill and underfill conditions in the pump. Pressure-based systems typically require separate components to address overfill conditions versus underfill conditions. The example pumps described herein use a single spool member to correct both overfill and underfill conditions. Further, the example valve spools disclosed herein function in conjunction with a pair of relatively simple check valves that receive little wear and use because they are only activated when an overfill or underfill condition is present. The limited activity of the valve spools limits wear and reduces the possibility for maintenance.

CONCLUSION

One aspect of the present disclosure relates to a diaphragm pump that includes a diaphragm, a pumping chamber, a transfer chamber, first and second fluid valves, a fluid reservoir, and a valve spool. The diaphragm is movable between first and second positions along a first axis. The pumping chamber is defined on one side of the diaphragm and is adapted to carry a fluid to be pumped. The transfer chamber is defined on the opposite side of the diaphragm and is filled with a hydraulic fluid. The first and second valves are configured as one-way valves. The fluid reservoir is in fluid communication with the transfer chamber via the first and second valves. The valve spool is positioned in the transfer chamber to control fluid flow through the first and second valves. The valve spool is moveable along a second axis that is different from the first axis between a plurality of positions relative to openings of the first and second valves.

Another aspect of the present disclosure relates to a hydraulically driven pump that includes a diaphragm, a piston, a transfer chamber, a fluid reservoir, and a spool member. The diaphragm is moveable about a first axis. The transfer chamber is defined between the diaphragm and the piston, and is filled with a hydraulic fluid. The fluid reservoir is in fluid communication with the transfer chamber via at least one valve. The spool member is configured to control fluid flow between the transfer chamber and the fluid reservoir. The spool member is moveable relative to the at least one valve when an overfill condition or an underfill condition exists in the transfer chamber. The spool member is arranged non-coaxial with the first axis.

A further aspect of the present disclosure relates to a method of balancing fluid pressure in a hydraulically driven diaphragm pump. The diaphragm pump includes a diaphragm, a piston, a transfer chamber interposed between the diaphragm and the piston, a fluid reservoir, a valve spool, and at least one valve providing fluid communication between the fluid reservoir and the transfer chamber. The method steps include moving the piston to move the diaphragm along a first axis, and moving the valve spool relative to the at least one valve member to control fluid flow between the fluid reservoir and the transfer chamber. The valve spool moves along a second axis that is non-coaxial with the first axis.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, inventive subject matter lies in less than all features of a single disclosed embodiment. Thus, the following claims are hereby incorporated into the detailed description, with each claim standing on its own as a separate preferred embodiment. Therefore, the spirit and scope of the appended claims should not be limited to the description of the preferred versions contained herein.

I claim:

1. A diaphragm pump, comprising:

a diaphragm movable between first and second positions along a first axis;

a pumping chamber on one side of the diaphragm, the pumping chamber adapted to carry a fluid to be pumped;

a transfer chamber on the other side of the diaphragm, the transfer chamber being filled with a hydraulic fluid;

first and second one-way valves;

a fluid reservoir in fluid communication with the transfer chamber via the first valve and a first conduit leading directly to the fluid reservoir, and the second valve and a second conduit extending directly from the fluid reservoir to the transfer chamber; and a valve spool positioned in the transfer chamber to control fluid flow through the first and second valves, the valve spool moveable along a second axis that is different from the first axis between a plurality of positions relative to openings to the first and second valves.

2. The diaphragm pump of claim 1, wherein the valve spool is moveable between a first position covering the openings to the first and second valves, a second position covering the opening to the first valve and removed from the opening to the second valve, and a third position covering the opening to the second valve and removed from the opening to the first valve.

3. The diaphragm pump of claim 2, wherein the valve spool is configured to maintain the first position until an overfill condition or an underfill condition is generated in the transfer chamber that moves the valve spool.

4. The diaphragm pump of claim 1, further comprising a valve arm coupled to the diaphragm and configured to engage the valve spool to move the valve spool when an overfill condition or an underfill condition is generated in the transfer chamber.

5. The diaphragm pump of claim 4, wherein the valve spool includes a recess portion, and a portion of the valve arm is moveable within the recess portion without moving the valve spool until the overfill condition or the underfill condition is generated.

6. The diaphragm pump of claim 1, further comprising a diaphragm rod assembly, the diaphragm rod assembly including a diaphragm rod and a biasing member, the diaphragm rod being secured to the diaphragm and the diaphragm rod assembly configured to apply a bias force to the diaphragm in a direction along the first axis.

7. The diaphragm pump of claim 6, further comprising a plunger piston configured for reciprocal movement in the pump, wherein the plunger piston and diaphragm rod are biaxial with each other to provide asynchronous movement of the piston and diaphragm.

8. The diaphragm pump of claim 6, wherein the diaphragm rod assembly is configured to generate a pressure condition in the transfer chamber that is greater than a pressure condition in the pumping chamber.

9. The diaphragm pump of claim 1, wherein the valve spool includes a fluid path defined along at least a portion of a length of the valve spool to provide fluid flow between the transfer chamber and the first and second valves.

10. A hydraulically driven pump, comprising:

a diaphragm moveable about a first axis;

a piston;

a transfer chamber defined between the diaphragm and piston, the transfer chamber being filled with a hydraulic fluid;

a fluid reservoir in fluid communication with the transfer chamber via a first one-way check valve and a first conduit leading directly to the fluid reservoir and a second one-way check valve and a second conduit extending directly from the fluid reservoir to the transfer chamber; and a valve spool configured to control fluid flow between the transfer chamber and the fluid reservoir, the valve spool moveable relative to the first and second valves when an overfill condition or an underfill condition exists in the transfer chamber, the valve spool arranged non-coaxial with the first axis.

11. The hydraulically driven pump of claim 10, further comprising a diaphragm rod assembly coupled to the diaphragm and moveable along the first axis, the diaphragm rod assembly configured to apply a biasing force to the diaphragm.

12. The hydraulically driven pump of claim 10, further comprising a valve arm coupled to the diaphragm and configured to engage the valve spool to move the valve spool when the overfill condition or the underfill condition is generated.

13. The hydraulically driven pump of claim 10, wherein the valve spool moves in a direction parallel to the first axis.

14. A method of balancing fluid pressure in a hydraulically driven diaphragm pump, the diaphragm pump including a diaphragm, a piston, a transfer chamber interposed between the diaphragm and the piston, a fluid reservoir, a valve spool, and a first one-way valve and a first conduit providing fluid flow from the transfer chamber directly to the fluid reservoir and a second one-way valve and a second conduit providing fluid flow directly from the fluid reservoir to the transfer chamber, the method comprising the steps of:

moving the piston to move the diaphragm along a first axis; and moving the valve spool relative to the first one-way valve and the second one-way valve to control fluid flow between the fluid reservoir and the transfer chamber, wherein the valve spool moves along a second axis that is non-coaxial with the first axis.

15. The method of claim 14, wherein moving the valve spool includes maintaining the valve spool in a first position restricting fluid flow through the first valve while the diaphragm moves until an overfill condition of fluid in the transfer chamber is generated and restricting flow through the second valve while the diaphragm moves until an underfill condition of fluid in the transfer chamber is generated.

16. The method of claim 14, wherein moving the valve spool includes engaging the valve spool with a valve arm, the valve arm being coupled to the diaphragm.

17. The method of claim 14, the valve spool defining a recess in its side, wherein the first valve is configured to permit fluid flow from the transfer chamber to the fluid reservoir and the second valve being configured to permit fluid flow from the fluid reservoir to the transfer chamber, wherein moving the valve spool includes moving the valve spool to a first position to expose an opening to the first valve and cover an opening to the second valve when an overfill pressure condition exists, and moving the valve spool to a second position to close the opening to the first valve and to expose an opening to the second valve when an underfill pressure condition exists.

18. The method of claim 17, wherein the valve spool maintains the second position during a steady state operation of the diaphragm pump to compensate for leakage of fluid from the transfer chamber via the piston.

19. The method of claim 14, wherein the diaphragm pump further includes an air bleed member, the method further comprising permitting passage of air out of the transfer chamber through the air bleed member while substantially restricting the flow of liquid from the transfer chamber.

20. The diaphragm pump of claim 1, further comprising a plunger piston configured for reciprocal movement in the pump, wherein the plunger piston and the spool extend in a substantially parallel direction.

21. The diaphragm pump of claim 2, the valve spool defining a recess in the side of the valve spool, wherein the valve spool is configured so that the end of the valve spool uncovers the first valve in the second position to provide fluid communication between the transfer chamber and the fluid reservoir, and the recess uncovers the second valve in the third position to provide fluid communication between the transfer chamber and the fluid reservoir.

* * * * *